US011089822B2

(12) United States Patent
Ramirez

(10) Patent No.: US 11,089,822 B2
(45) Date of Patent: Aug. 17, 2021

(54) WEARABLE ELASTIC PAIRING DEVICE FOR CLOTHING

(71) Applicant: Alex J. Ramirez, Fort Worth, TX (US)

(72) Inventor: Alex J. Ramirez, Fort Worth, TX (US)

( * ) Notice: Subject to any disclaimer, the term of this patent is extended or adjusted under 35 U.S.C. 154(b) by 224 days.

(21) Appl. No.: 16/046,435

(22) Filed: Jul. 26, 2018

(65) Prior Publication Data

US 2018/0332898 A1 Nov. 22, 2018

Related U.S. Application Data

(63) Continuation of application No. 15/191,709, filed on Jun. 24, 2016, now abandoned.

(60) Provisional application No. 62/185,392, filed on Jun. 26, 2015.

(51) Int. Cl.
*A47B 11/00* (2006.01)
*A41B 11/00* (2006.01)

(52) U.S. Cl.
CPC ..... *A41B 11/002* (2013.01)

(58) Field of Classification Search
CPC ..... A41B 11/002
See application file for complete search history.

(56) References Cited

U.S. PATENT DOCUMENTS 3,994,265 A * 11/1976 Banks ..... A01K 27/005 119/865
5,483,704 A * 1/1996 Filipiak ..... A41F 13/00 2/239
5,551,128 A * 9/1996 Townsend ..... D06F 95/008 24/302
6,179,177 B1 * 1/2001 Hihara ..... A44C 5/145 224/164
2014/0208546 A1 * 7/2014 Lee ..... A44B 11/24 24/3.2
2015/0259191 A1 * 9/2015 Rider ..... B68C 1/16 24/181

* cited by examiner

*Primary Examiner* — Clinton T Ostrup
*Assistant Examiner* — Andrew Wayne Sutton
(74) *Attorney, Agent, or Firm* — Leavitt Eldredge Law Firm

(57) ABSTRACT

A pairing device for securing to articles of clothing together includes a first fastener assembly, having a male buckle having a rigid protrusion extending from the male buckle; and a first band attached to the male buckle and to secure to a first of the articles of clothing; a second fastener assembly, having a female buckle with a flexible opening to receive the rigid male protrusion; and a second band attached to the female buckle and to secure to a second of the articles of clothing; the male buckle and female buckle are to secure together, thereby securing the first article of clothing to the second article of clothing.

10 Claims, 14 Drawing Sheets

WEARABLE ELASTIC PAIRING DEVICE FOR CLOTHING

BACKGROUND

1. Field of the Invention

This invention is in the field of clothing. Embodiments of this invention are directed to a fastener system suitable for coupling pairs of clothing items to one another.

2. Description of Related Art

A frequent annoyance to many people is the misplacing or loss of one of the pairs of clothing. A common example of this annoyance is the loss of one sock somewhere along the path from the clothes hamper, to the washer and dryer, and back to the owner's sock drawer.

Devices for attaching socks in a pair to one another for purposes of storage and laundry are known in the art. Many of these conventional devices attach to each sock or garment at a single point of attachment. But such attachment renders the sock vulnerable to tearing as stress is applied, such as during machine washing and drying.

Embodiments of the invention provide a pairing device for socks and other clothing comprised of a pair of fastener assemblies, each comprised of an elastic band and a fastener attached to the band. The fasteners mate with one another, for example as male and female portions of a single center release buckle. Each of the two fastener assemblies is attached to the sock at two points of attachment that extend in a direction in which the sock stretches when worn; typically in a direction parallel to the top hem of the sock.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
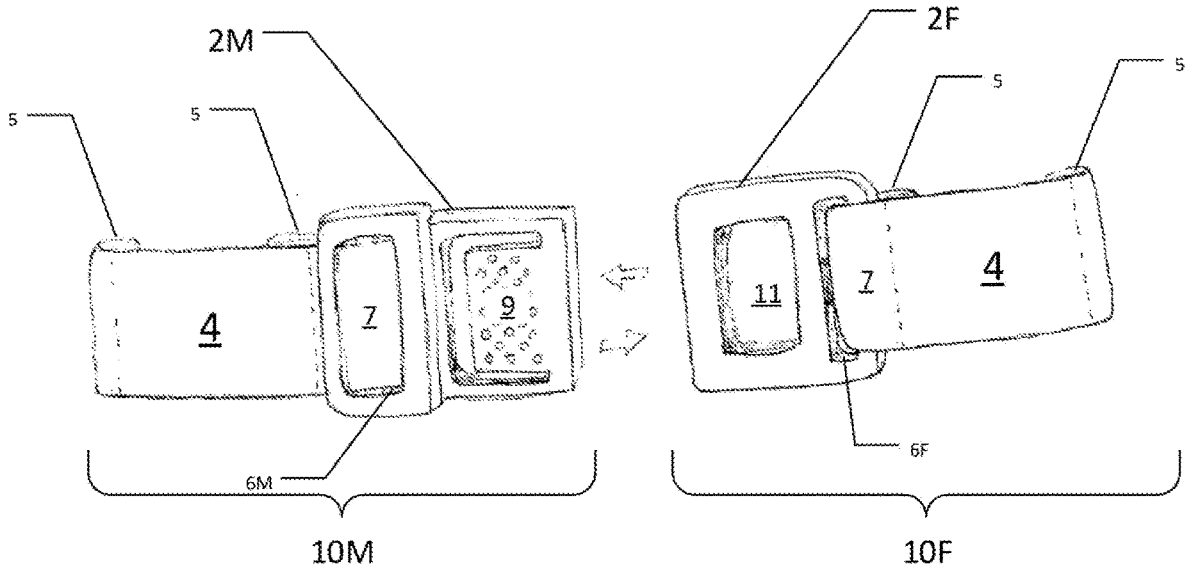
FIG. 1 is an elevation view of buckle assemblies according to an embodiment of the invention.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

The one or more embodiments described in this specification are described in connection with a pair of socks, such as athletic or dress socks, as the invention is believed to be particularly beneficial in such applications. However, it is also contemplated that concepts of this invention may be beneficially applied to other types of paired garments, particularly those that stretch when worn and are snug-fitting, for example pajamas, gloves, swimwear, and the like.

Accordingly, it is to be understood that the following description is provided by way of example only, and is not intended to limit the true scope of this invention as claimed.

These embodiments are directed to a pairing device for use with paired garment items, such as socks, that are desired to be kept together during laundry, drying, and storage. As mentioned above, one sock out of a pair is often misplaced or lost somewhere along the route from the clothes hamper, to the washer and dryer, and back to the owner's sock drawer. For the case of athletic socks, one of the socks in a pair can also be lost in a gym bag, or inadvertently not even packed, leaving the athlete in an awkward position on arriving at a competition. Also as mentioned above, one type of conventional pairing device attaches to the sock or garment at a single point of attachment; this type of pairing device renders the sock or garment vulnerable to tearing, particularly during the laundry cycle while the socks are attached to one another.

Another limitation of conventional devices for attaching paired garments to one another is discomfort caused by the device while the socks are being worn. Because socks stretch to closely fit the foot and ankle when worn, conventional pairing devices are generally noticeable and annoying, if not uncomfortable, to the wearer when worn. Because of these limitations, pairing devices for socks and similar stretchable and snug-fitting garments are not commonly used.

These embodiments provide pairing devices that are less likely to tear the socks to which they are attached, and that are much less noticeable to the wearer. FIG. 1 illustrates an embodiment of a pairing device including two fastener assemblies, each for securing to one of the socks in a pair. In this embodiment, the two fastener assemblies are constituted by male buckle assembly 10M, having male buckle element 2M, and female buckle assembly 10F, having female buckle element 2F. In buckle assemblies 10M, 10F, buckle elements 2M, 2F are constructed so as to mate with one another by insertion of male buckle element 2M into female buckle element 2F as will be described below. Buckle elements 2M, 2F may be constructed of a durable plastic such as an acetal engineering thermoplastic or another thermoplastic, so as to be heat-resistant and thus dryer-safe. In this embodiment, each of male buckle element 2M and female buckle element 2F is attached to a corresponding stretchable band, which in this embodiment is constituted by elastic band 4.

Figure 2A:
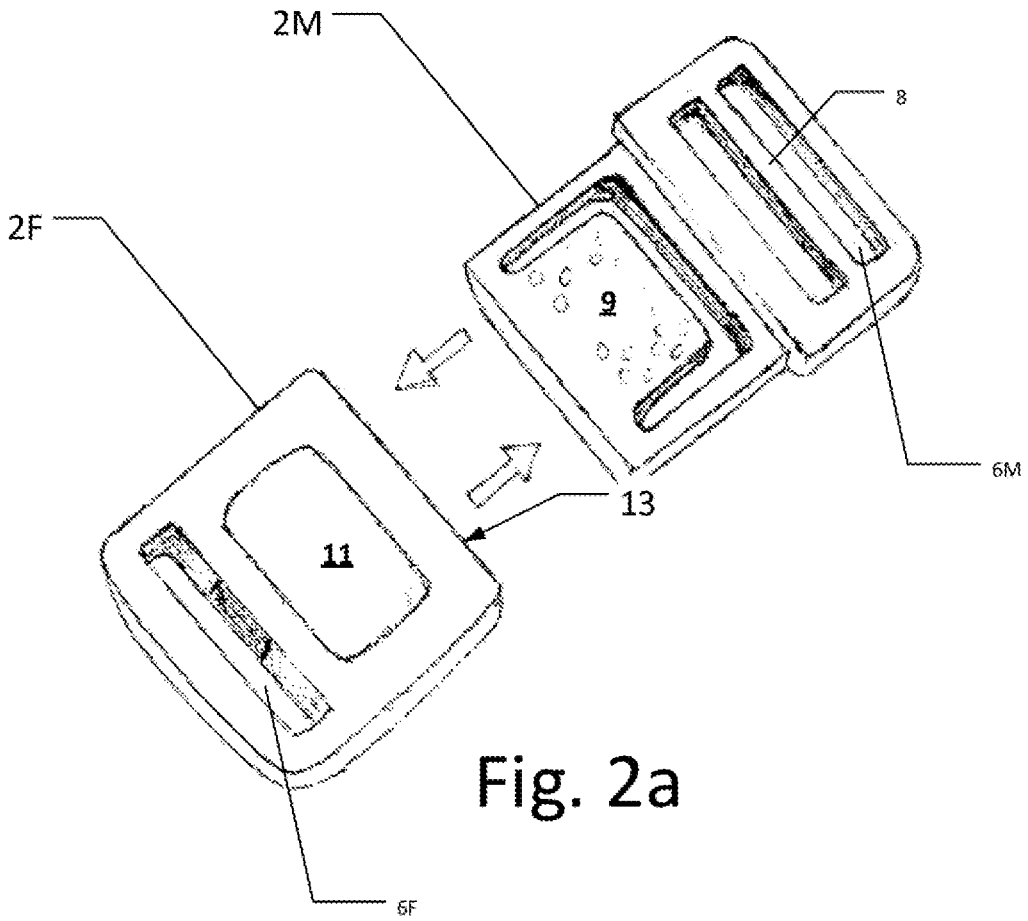
FIGS. 2*a* and 2*b* are perspective views illustrating the construction and mating of buckle elements according to an embodiment of the invention.
Figure 2B:
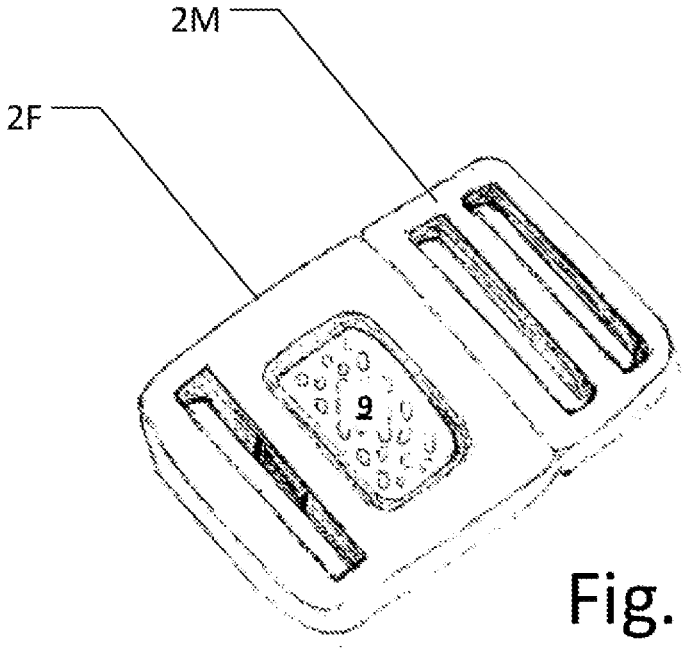

FIGS. 2*a* and 2*b* illustrate in more detail the construction of male buckle element 2M and female buckle element 2F. In this embodiment, buckle elements 2M, 2F correspond to a conventional center release plastic buckle, such as the "button and buckle" type available from Best Buy. Male buckle element 2M has bendable tab portion 9 that inserts into a corresponding slot 13 along the edge of female buckle element 2F. Opening 11 through female buckle element 2F is contiguous with slot 13, such that when tab portion 9 is fully inserted into slot 13 (see FIG. 2*b*), it latches against an interior edge of opening 11 so as to retain the buckle closed. Tab portion 9 is visible through opening 11, to allow the user to open the buckle by pressing down on tab portion 9, as known in the art.

As shown in FIGS. 2*a* and 2*b*, male buckle element 2M has a pair of openings 6M on either side of post 8 on its distal end from tab portion 9, while female buckle element 2F has opening 6M on its distal end from slot 13. Openings 6M and 6F are used to secure male buckle element 2M and female buckle element 2F, respectively, to their respective elastic bands 4, as will now be described relative to FIGS. 1, 3*a*, and 3*b*.

Elastic bands 4 may be formed of conventional elastic material, for example of a lightweight elastic that narrows when stretched; a typical composition of this elastic is 55% polyester and 45% rubber such as available from Prym Consumer USA This elastic is machine washable and dryer-safe at temperatures up to 200° F. Elastic bands 4 may be marked with brand logos or decorative elements, as desired.

Figure 3A:
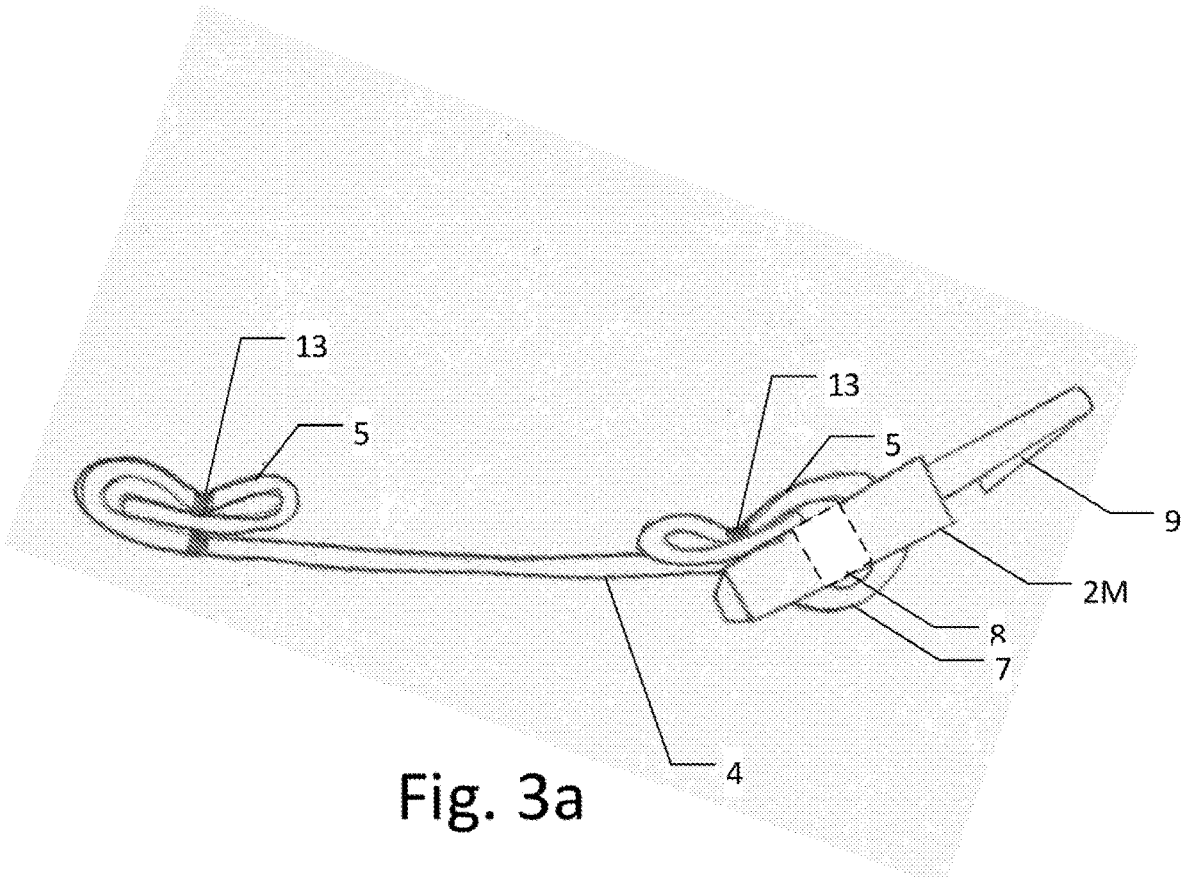
FIGS. 3*a* and 3*b* are edge views of the buckle assemblies according to an embodiment of the invention illustrating the attachment of the buckle elements to elastic bands.
Figure 3B:
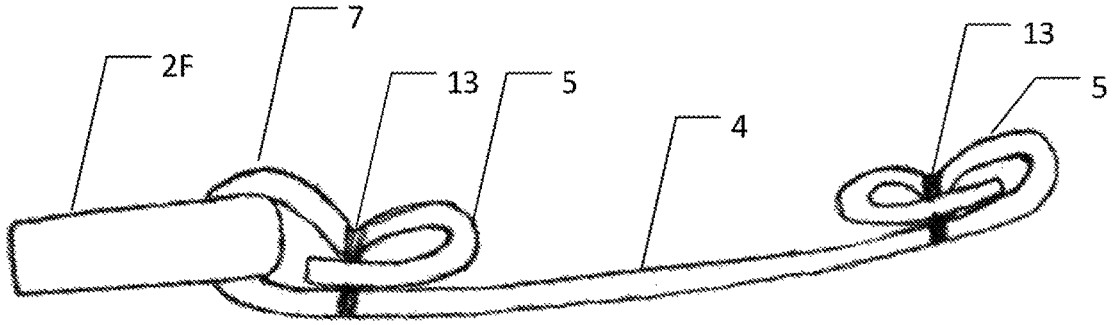

Referring first to FIG. 3*a*, male buckle element 2M is secured to elastic band 4 by way of sewn loop 7, to form buckle assembly IOM. Loop 7 is at one end of elastic band 4, and is formed by the end of elastic band 4 passing through openings 6M, around post 8, and forming a doubled-over back portion 5. Stitching 13 secures doubled-over back portion 5 to the back of elastic band 4, and secures male buckle element 2M within loop 7; in this case, stitching 13 passes through the material of elastic band 4 three times, as the end of band 4 is looped back again under the doubled-over portion as shown. Elastic band 4 is doubled over on its distal end from male buckle element 2M, with stitching 13 securing doubled-over back portion 5 at that end also. FIG. 3*b* shows female buckle element 2F as similarly attached to its elastic band 4, to form a buckle assembly, by loop 7 defined by elastic band 4 passing through opening 6F of female buckle element 2F doubling-over to form back portion 5, which is secured in place by stitching 13. Elastic band 4 is also doubled over on its distal end from female buckle element 2F to form back portion 5, which is secured in place by stitching 13. Male buckle element 2M and female buckle element 2F are thus both permanently secured to respective elastic bands 4.

Alternatively, buckle elements 2M and 2F may be attached to their respective elastic bands 4 between the loops 7. For example, the middle portion elastic band 4, between loops 5, may pass through one or both of the openings 6M of male buckle element 2M. Male buckle element 2M may thus slide or be slid along the length of elastic band 4. Similarly, elastic band 4 may pass through opening 6F of female buckle element 2F; on this case, female buckle element 2F may easily slide along the length of elastic band 4 between its loops 5.

However, it is contemplated that, for most applications, it will typically be preferred to attach buckle elements 2M and 2F at a loop 7 of their respective elastic bands 4 as described above, rather than between loops 7, as such attachment will prevent buckle elements 2M, 2F from moving or swinging during wear. In addition, attachment at loops 7 maximizes the distance between the points at which buckle assemblies 1OM, 1OF are attached to socks SCK, allowing elastic bands 4 to freely stretch and thus remain comfortable to the wearer. If a logo is imprinted on elastic bands 4, as is contemplated, placement of buckle elements 2M, 2F at ends of elastic bands 4 will also fully expose that logo.

Figure 4A:
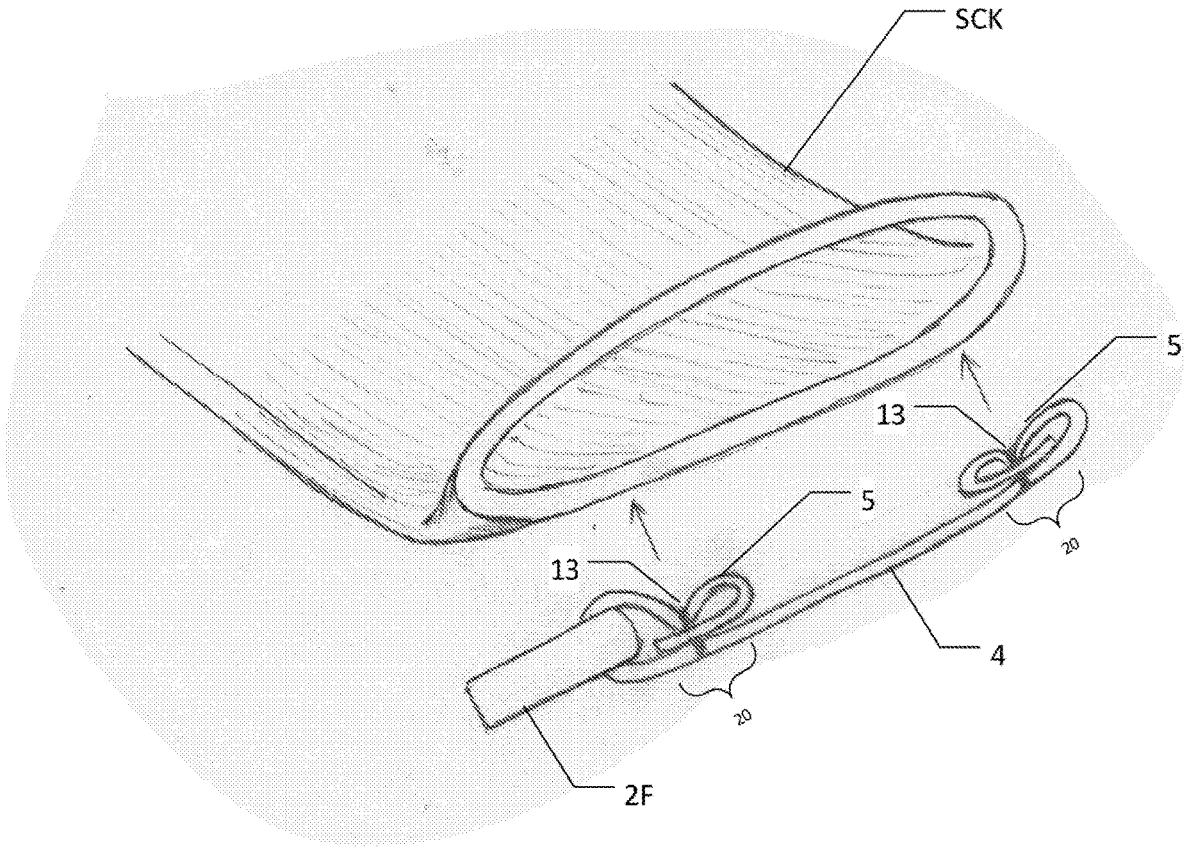
FIGS. 4*a* and 4*b* are perspective views illustrating the attachment of buckle assemblies to respective items of clothing according to an embodiment of the invention.
Figure 4B:
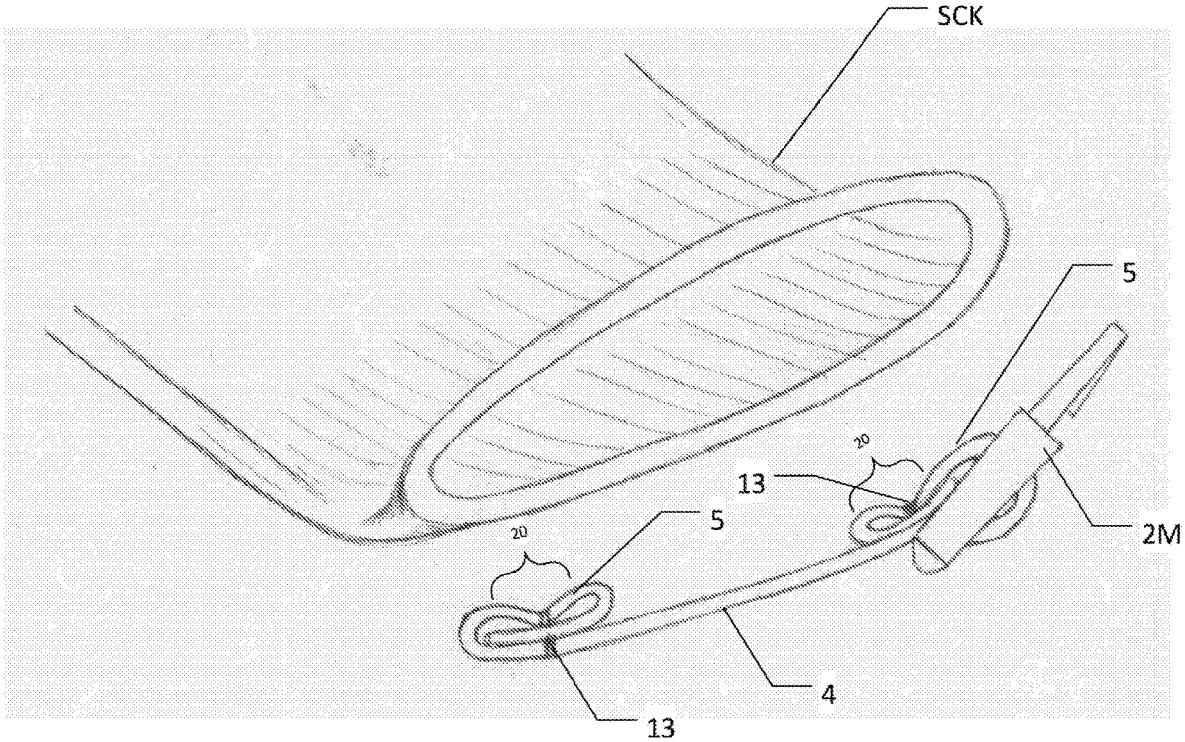
Figure 5A:
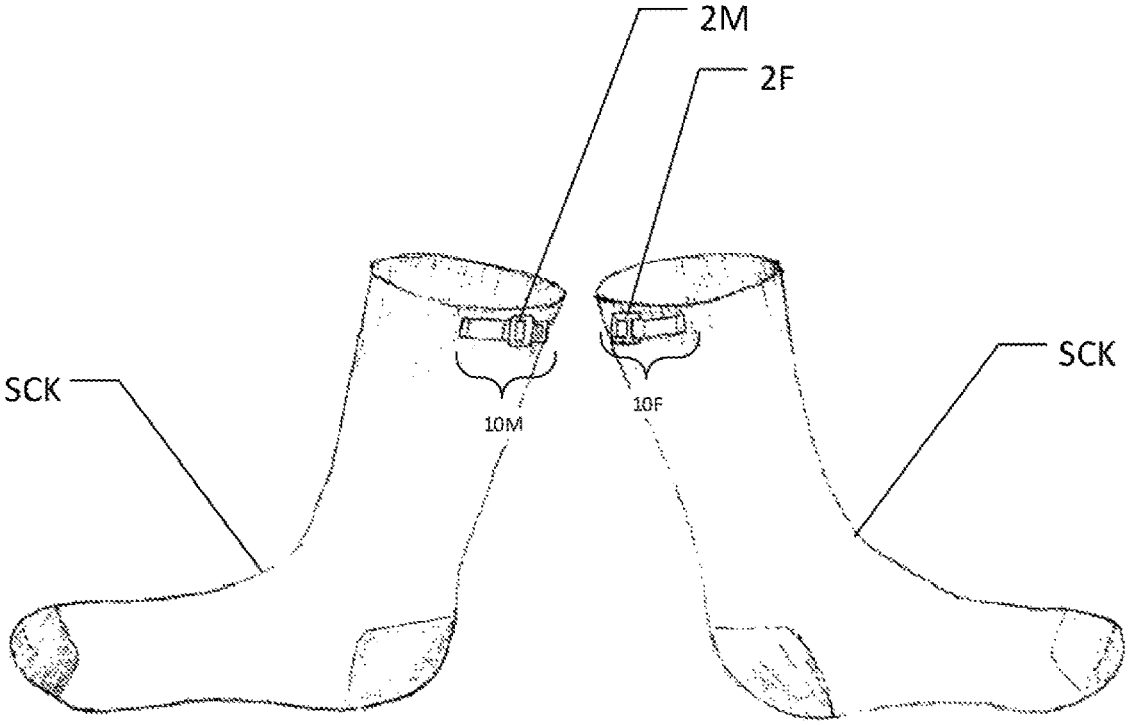
FIGS. 5*a* and 5*b* are perspective views illustrating the buckle assemblies according to an embodiment of the invention as applied to a pair of socks.
Figure 5B:
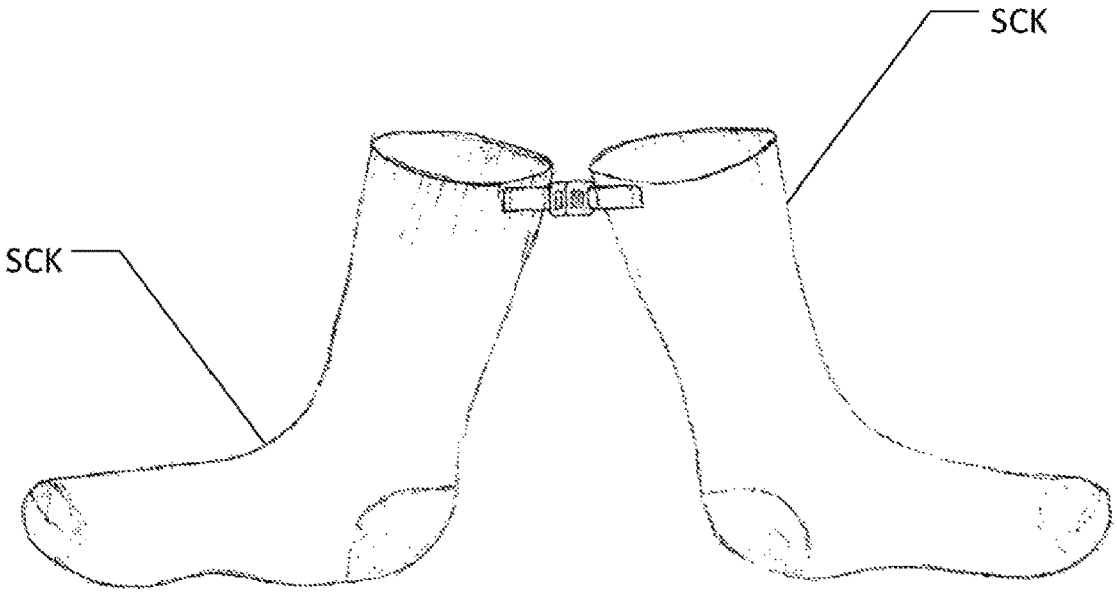

According to these embodiments, the pairing device formed of the buckle assemblies including buckle elements 2M, 2F are secured to clothing items by way of their respective elastic bands 4. FIG. 4*a* illustrates the example of the buckle assembly with female buckle element 2F being secured to sock SCK; FIG. 4*b* is a similar view for the buckle assembly with male buckle element 2M. In this embodiment, the sewing of stitching 13 to attach buckle elements 2M, 2F within loops 7 of their respective elastic bands 4 is performed in advance of attaching buckle assemblies 1OM, 1OF to socks SCK, and elastic bands 4 are attached to sock SCK at the location of doubled-over back portion. Separate stitching (not shown in FIGS. 4*a* and 4*b*) will be sewn at a point along and through each of the two doubled-over back portions 5 of each band 4, for example at a point within region 20 shown in FIGS. 4*a* and 4*b*. This sewing of both doubled-over portions 5 of elastic band 4 to sock SCK provides two points of attachment for each buckle assembly 10M, 10F, reducing the likelihood of tearing during the laundry cycle. Alternatively, the same stitching 13 that secures back portions 5 to elastic band 4, and thus buckle element 2M, 2F within its sewn loop 7, may also its attach buckle assembly 1OM, 1OF to the clothing item. In this case, stitching 13 would be simultaneously sewn through doubled-over band 4 and sock SCK in a single sewing operation, both securing buckle elements 2M, 2F within loops 7 and, at the same time, also attaching elastic bands 4 to the clothing item (e.g., sock SCK) at two points of attachment.

One application of these embodiments of the invention is to maintain socks as pa1*rs*. Figures Sa and Sb illustrate this application, with male buckle assembly 10M and female buckle assembly 1OF attached to the upper portion of respective socks SCK in the manner described above. While Figures Sa and Sb illustrate application of this embodiment to crew length socks, it is contemplated that these embodiments may alternatively be applied to a wide range of sock types that also includes dress socks, ankle socks, and "no-show" socks, to name a few. In Figure Sa, buckle elements 2M, 2F are separated from and not mated with one another, such as while socks SCK are being worn, while in Figure Sb, buckle elements 2M, 2F are mated to one another, such as while socks SCK are awaiting laundering, are in the laundry cycle, or are in storage. For this application, it is contemplated that the width of elastic bands 4 will be on the order of 1 cm, and the length of buckle assemblies 1 OM, 1 OF will be on the order of 3 to 5 cm. Of course, the sizes of these items may vary widely, depending on the particular application.

Figure 6:
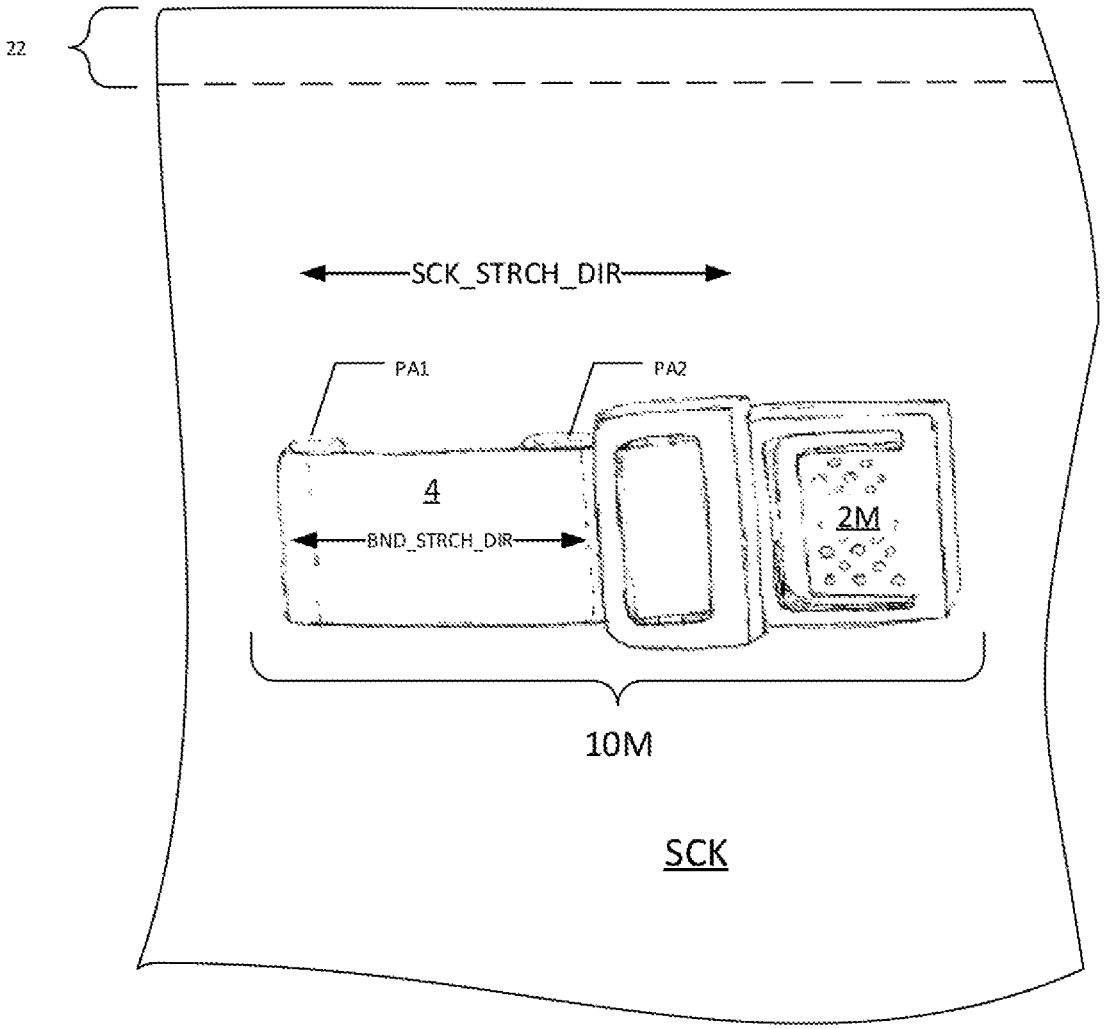
FIG. 6 is an elevation view illustrating the relationship between the direction that the garment stretches when worn and the direction in which the elastic bands of the buckle assemblies of FIG. 1 stretch, according to an embodiment.

FIG. 6 illustrates the operation of buckle assembly 10M on sock SCK when worn; buckle assembly 10F will operate similarly. When worn, sock SCK of course stretches primarily circumferentially around the wearer's ankle, as compared with the extent to which it stretches vertically (i.e., in the direction from the wearer's ankle to his knee). As such, in the view of FIG. 6, the primary direction SCK_STRCH_DIR in which sock SCK is stretched is horizontal, parallel with its top hem 22. According to this embodiment, the two points of attachment PA1, PA2 of buckle assembly 10M to sock SCK are oriented substantially horizontally with one another so that elastic band 4 stretches along its length, in direction BND_STRCH_DIR, as sock SCK stretches in the primary direction SCK STRCH DIR when worn. This direction BND STRCH DIR is the direction in which elastic band 4 stretches longer and more easily; elastic band 4 may also stretch perpendicular to direction BND_STRCH_DIR, but will stretch in that perpendicular direction to a much lesser extent than in direction BND_STRCH_DIR. Stated another way, the two points of attachment PA1, PA2 at which elastic band 4 is attached to sock SCK extend along a line that is substantially in the primary direction of stretch SCK_STRCH_DIR, such that elastic band 4 stretches in its longitudinal direction BND_STRCH_DIR that is substantially parallel with the primary stretch direction SCK_STRCH_DIR of sock SCK.

This orientation of buckle assemblies 10M, 10F so as to stretch in direction BND_STRCH_DIR along with the stretching of socks SCK m direction SCK_STRCH_DIR minimizes the deformation of socks SCK caused by the pairing devices, when socks SCK are worn. More specifically, as socks SCK are stretched around the lower leg of the wearer, elastic bands 4 also stretch and do not constrain the tops of those socks SCK, and thus reduces the sensation of tugging or stiffness that the wearer experiences. This cooperative stretching of elastic bands 4 with socks SCK also allows buckle assemblies 10M, 10F to essentially lie flat along socks SCK, further reducing the extent to which the wearer notices their presence. The attachment of buckle elements 2M, 2F by looping elastic bands 4 through the buckle openings and then stitching them at their ends, as described above relative to FIGS. 3*a* and 3*b*, also helps to keep buckle elements 2M, 2F flat, and thus unnoticeable, when socks SCK are worn. Accordingly, this pairing 5 device is a comfortable, if not unnoticed, approach to maintaining paired items to one another during laundry and storage, without annoying the wearer. In addition, the indirect attachment of buckle elements 2M, 2F to socks SCK via elastic bands 4, at two points of attachment, allows the paired socks SCK to be latched together during machine washing and drying, without the risk of tearing as would occur if buckle elements 2M, 2F were attached directly to the items and mated to one another during these operations.

Figure 7:
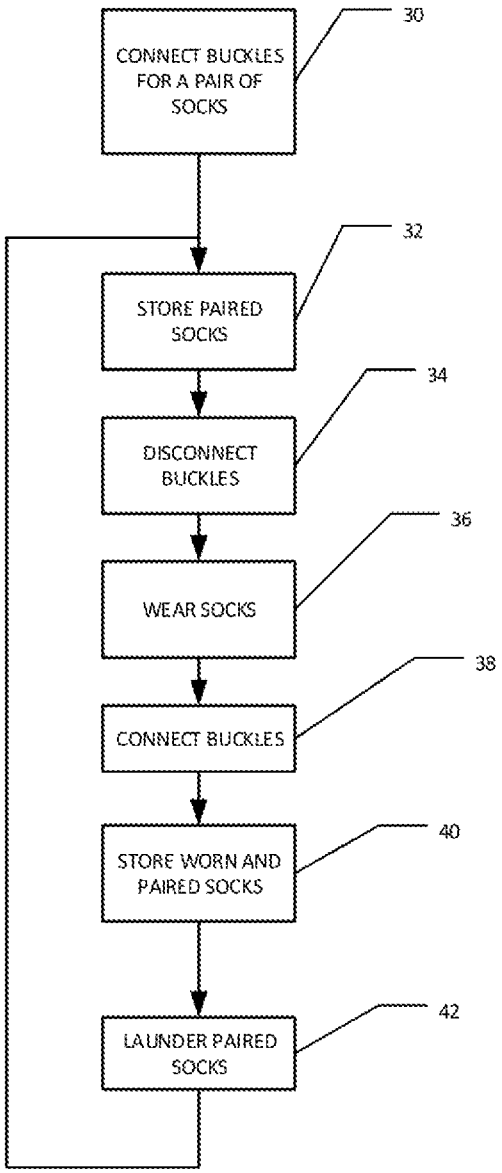
FIG. 7 is a flow diagram illustrating the cycle of usage for a pair of socks constructed according to these embodiments.

FIG. 7 illustrates a typical cycle of usage for a pair of socks SCK on which buckle assemblies 1OM, 1OF are attached according to these embodiments. For the sake of this description, the cycle begins with process 30, in which newly purchased socks SCK are connected to one another as a pair by inserting buckle element 2M of one sock SCK into buckle element 2F of its partner in the pair; the paired socks SCK can then be stored in this paired arrangement in process 32, awaiting wear. When the user wishes to wear socks SCK, buckle assemblies 2M, 2F are disconnected from one another in process 34, and unpaired socks SCK are then worn by the user in process 36. After wear is completed, socks SCK are re-connected to one another as a pair in process 38, and are then stored in their paired state prior to laundry, for example in a hamper, in process 40. Laundering (i.e., washing and drying) of socks SCK as paired is then performed in process 42, following which paired socks SCK can then be stored again in process 32 to await the next time to be worn. According to this cycle of usage, socks SCK are only unpaired during wear; during all other times, in storage prior to wear, in storage prior to laundry, and during laundering, socks SCK may be connected by buckle assemblies 1OM, 1OF and thus maintained as paired. It is therefore contemplated that the likelihood of losing one sock in a pair of socks during the storage and laundry cycle will greatly decrease, without subjecting the wearer to discomfort or annoyance during wear.

While one or more embodiments have been described in this specification, it is of course contemplated that modifications of, and alternatives to, these embodiments, such modifications and alternatives capable of obtaining one or more the advantages and benefits of this invention, will be apparent to those of ordinary skill in the art having reference to this specification and its drawings. It is contemplated that such modifications and alternatives are within the scope of this invention.

Figure 8:
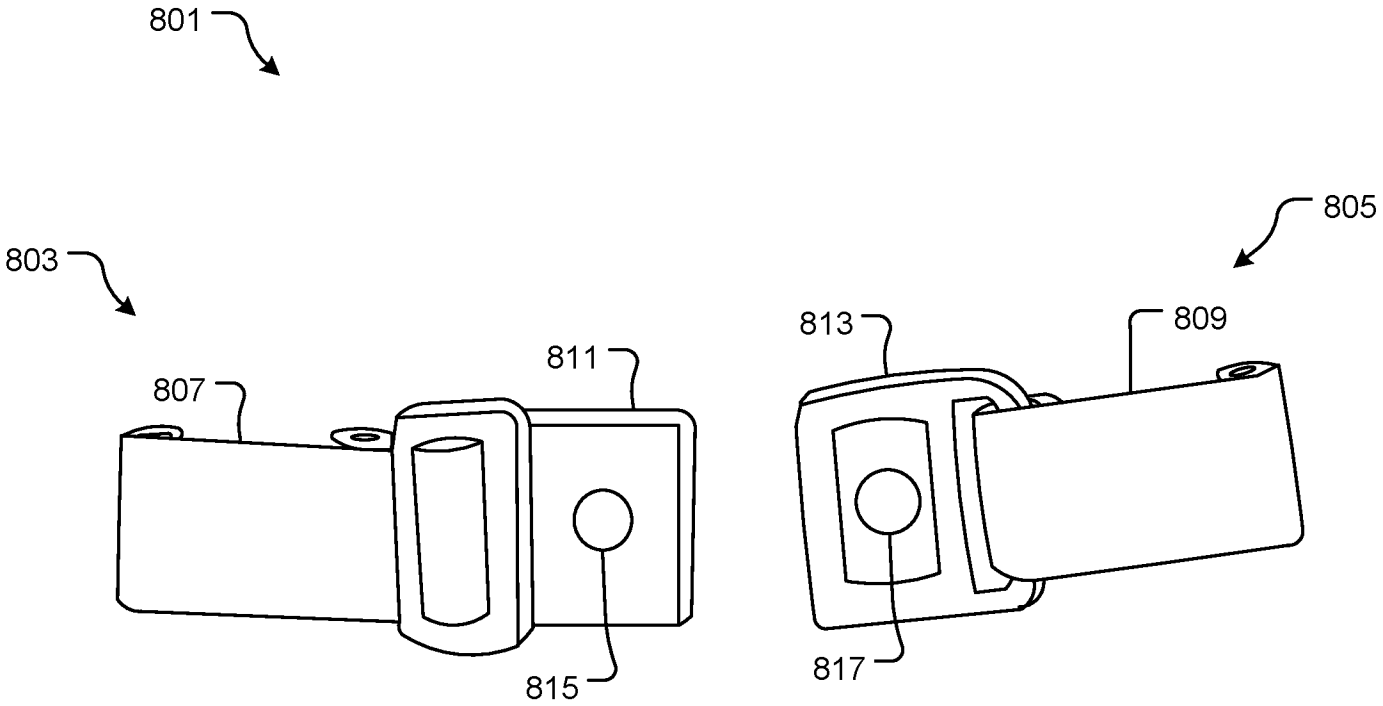
FIG. 8 is an elevation view of a pairing device with a buckle assembly in accordance with an alternative embodiment of the present application.
Figure 9:
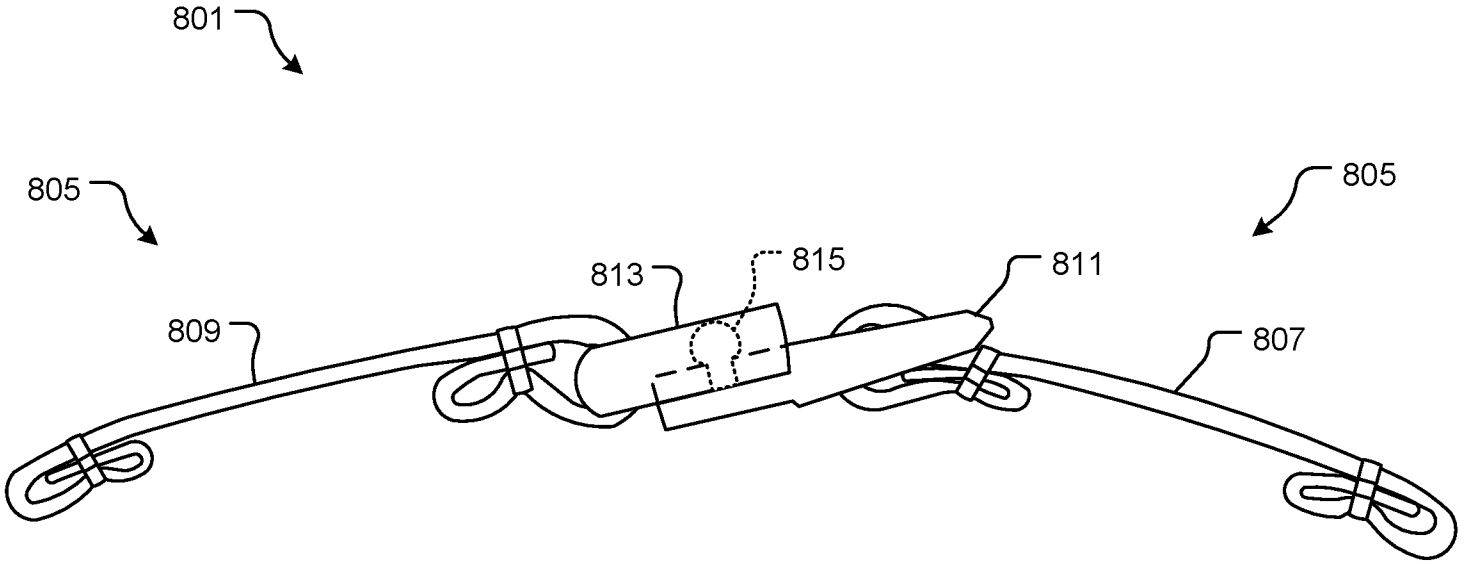
FIG. 9 is an edge view of the buckle assembly of FIG. 8 illustrating the engagement of the buckle elements.

In FIGS. 8 and 9, an alternative embodiment of a pairing device 801 is shown, which can include some or all of the features discussed above and having a first fastener assembly 803 and a second fastener assembly 805, each having an elastic band 807, 809, and buckles 811, 813. In this embodiment, the male buckle 811 includes a rigid protrusion 815 configured to engage with a flexible opening 817 of female buckle 813. This configuration is further shown in FIG. 9. It is contemplated that protrusion 815 can be composed of a hard plastic and can be bulb shaped, while opening 817 is surrounded by a flexible rubber.

Figure 10:
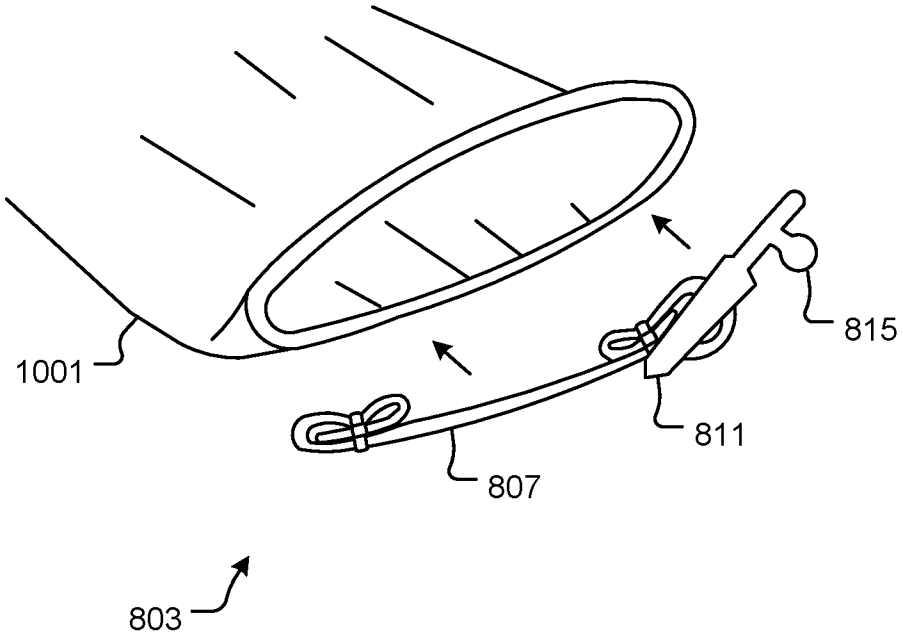
FIG. 10 is a perspective view illustrating the attachment of a buckle assembly of FIG. 8 to an article of clothing.
Figure 11:
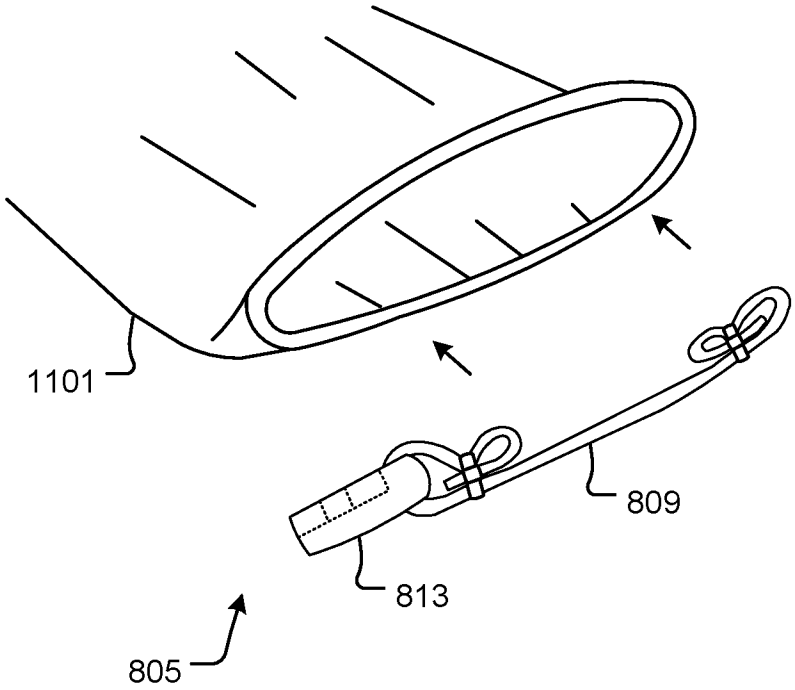
FIG. 11 is a perspective view illustrating the attachment of a buckle assembly of FIG. 8 to an article of clothing.

In FIGS. 10 and 11, the first and second assemblies 803, 805 are shown being attached to a pair of socks 1001, 1101, as is previously shown and described.

Figure 12:
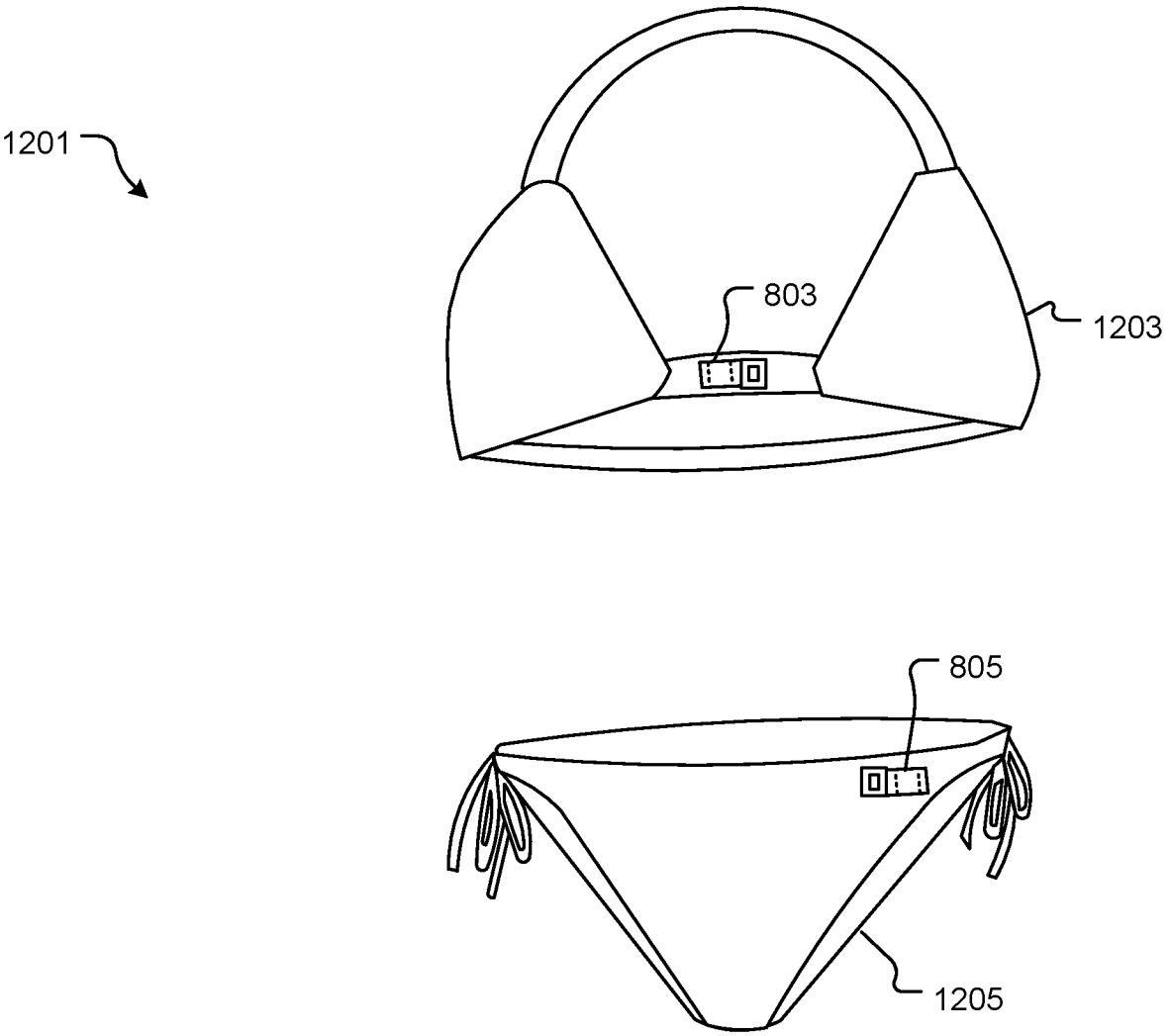
FIG. 12 is a front view illustrating a first clothing system having the pairing device of FIG. 8.

In FIG. 12, a first clothing system 1201 having first and second assemblies 803, 805 attached thereto, and configured to engage together to hold two pieces of clothing, namely a swimsuit top 1203 and swimsuit bottom 1205 together for storage and transportation is shown. It should be appreciated and understood that the exact location and method of securing can vary.

Figure 13:
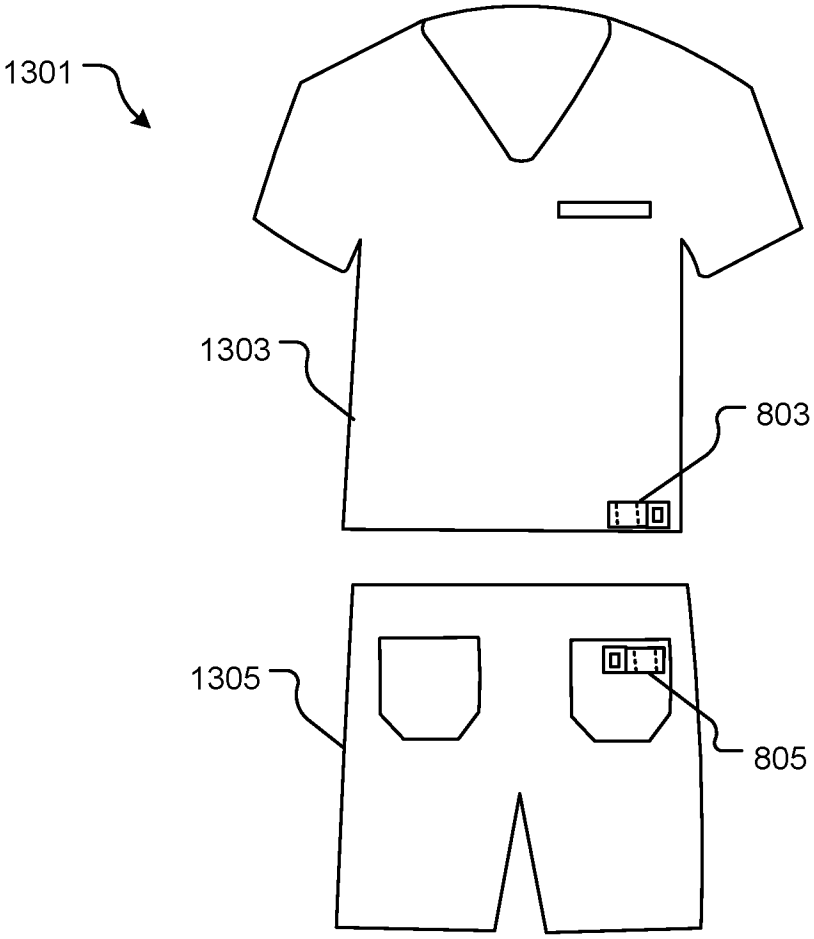
FIG. 13 is a front view illustrating a second clothing system having the pairing device of FIG. 8.

In FIG. 13, a second clothing system 1301 is shown, having first and second assemblies 803, 805 configured to secure together a top 1303 and a bottom 1305. It should be appreciated that this is ideal for matching elements, such as scrubs, workout gear, uniforms, or any other clothing items that the user desires to pair together.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. A pairing device for securing to articles of clothing together, the device comprising:

a first fastener assembly, having:

a male buckle having a rigid protrusion extending from the male buckle;

a first band attached to the male buckle and configured to secure to a first of the articles of clothing, the first band having a first elongated length extending from a first end to a second end, the first end having a first loop secured to the male buckle, the second end having a second loop, the first loop and the second loop are doubled over, the first end and the second end is fixedly secured to the first article of clothing; and a first stitching configured to secure the first loop and the second loop in a first doubled over position;

a second fastener assembly, having:

a female buckle with a flexible opening configured to receive the rigid male protrusion;

a second band attached to the female buckle and configured to secure to a second of the articles of clothing, the second band having a second elongated length extending from a third end to a fourth end, the third end having a third loop secured to the female buckle, the fourth end having a fourth loop, the third loop and the fourth loop are doubled over, the third end and the forth end is fixedly secured to the second article of clothing; and a second stitching configured to secure the third loop and the fourth loop in a second doubled over position;

wherein the male buckle and female buckle are configured to secure together, thereby securing the first article of clothing to the second article of clothing; and wherein the rigid protrusion is a bulb composed of a plastic material.

2. The pairing device of claim 1, wherein the first band and the second band are stretchable.

3. The pairing device of claim 1, wherein the flexible opening is surrounded by flexible rubber.

4. The pairing device of claim 1, wherein the first fastener assembly further comprises:

a sewn loop formed into the first band.

5. A clothing system comprising:

a first article of clothing configured to be worn on the user's torso;

a second article of clothing configured to be worn on the user's lower body; and a pairing device configured to provide a means to secure the first article and the second article together, the pairing device comprising:

a first fastener assembly, having:

a male buckle having a rigid protrusion extending from the male buckle;

a first band attached to the male buckle and configured to secure to the first of the articles of clothing, the first band having a first elongated length extending from a first end to a second end, the first end having a first loop secured to the male buckle, the second end having a second loop, the first loop and the second loop are doubled over, the first end and the second end is fixedly secured to the first article of clothing; and a first stitching configured to secure the first loop and the second loop in a first doubled over position;

a second fastener assembly, having:

a female buckle with a flexible opening configured to receive the rigid male protrusion;

a second band attached to the female buckle and configured to secure to the second of the articles of clothing, the second band having a second elongated length extending from a third end to a fourth end, the third end having a third loop secured to the female buckle, the fourth end having a fourth loop, the third loop and the fourth loop are doubled over, the third end and the forth end is fixedly secured to the second article of clothing; and a second stitching configured to secure the third loop and the fourth loop in a second doubled over position;

wherein the male buckle and female buckle are configured to secure together, thereby securing the first article of clothing to the second article of clothing; and wherein the rigid protrusion is a bulb composed of a plastic.

6. The system of claim 5, wherein the first article and second article are swimsuit pieces.

7. The system of claim 5, wherein the first article and second article are a uniform.

8. The system of claim 5, wherein the first band and the second band are stretchable.

9. The system of claim 5, wherein the flexible opening is surrounded by flexible rubber.

10. The system of claim 5, wherein the first fastener assembly further comprises: a sewn loop formed into the first band.

* * * * *